United States Patent [19]

Kimura et al.

[11] Patent Number: 4,618,085

[45] Date of Patent: Oct. 21, 1986

[54] SHEET SEPARATING APPARATUS

[75] Inventors: Tokuji Kimura; Toshio Urushihara, both of Yokohama, Japan

[73] Assignee: Kabushiki Kaisha Toshiba, Japan

[21] Appl. No.: 626,389

[22] Filed: Jun. 29, 1984

[30] Foreign Application Priority Data

Jun. 30, 1983 [JP] Japan ..... 58-119568

[51] Int. Cl.[4] ..... B65H 35/10

[52] U.S. Cl. ..... 225/100; 225/4

[58] Field of Search ..... 225/100, 2, 4, 98, 97

[56] References Cited

U.S. PATENT DOCUMENTS

| | | | |
|---|---|---|---|
| 2,268,190 | 12/1941 | Copeland et al. | 225/100 |
| 2,375,542 | 5/1945 | Euth | 225/100 |
| 2,800,180 | 7/1957 | Jensen | 225/100 X |
| 3,070,009 | 12/1962 | Kessler | 225/100 X |
| 3,135,446 | 6/1964 | Sargent | 225/100 |
| 3,792,807 | 2/1974 | Mare et al. | 225/100 |
| 4,145,035 | 3/1979 | Moser | 225/100 X |
| 4,397,410 | 8/1983 | Schueler | 225/100 X |
| 4,454,973 | 6/1984 | Irvine | 225/4 X |

FOREIGN PATENT DOCUMENTS

| | | |
|---|---|---|
| 1172641 | 12/1969 | United Kingdom . |
| 1326814 | 8/1973 | United Kingdom . |
| 1356767 | 6/1974 | United Kingdom . |
| 1558749 | 1/1980 | United Kingdom . |
| 2039265 | 8/1980 | United Kingdom . |
| 2131400 | 6/1984 | United Kingdom . |

OTHER PUBLICATIONS

Bernard "Progressive Bursting," 16 *IBM Technical Disclosure Bulletin* 2629–30 (Jan. 1974).

*Primary Examiner*—Frank T. Yost

*Attorney, Agent, or Firm*—Finnegan, Henderson, Farabow, Garrett & Dunner

[57] ABSTRACT

A sheet separating apparatus is designed so that tension is applied to a continuous sheet having weakened lines arranged thereon at predetermined distances so that the continuous sheet is separated along the weakened lines. The sheet separating apparatus comprises first and second conveying mechanisms spaced from each other and adapted to transfer the continuous sheet and to increase tension on the continuous sheet along the course of transfer thereof, and a guide roller for maximizing the increased tension at a predetermined position in the continuous sheet, thereby starting separation of the continuous sheet at that portion of each weakened line which corresponds to the predetermined position.

1 Claim, 12 Drawing Figures

SHEET SEPARATING APPARATUS

BACKGROUND OF THE INVENTION

The present invention relates to a sheet separating apparatus for separating a continuous sheet of paper or the like which has weakened lines, such as perforations, arranged at predetermined distances from one another.

Conventionally, a continuous sheet, such as a continuous slip of paper, is separated into a plurality of slips by using a cutting apparatus which combines a movable cutting edge with a fixed cutting edge, and is set in a suitable position on a conveying path for the continuous sheet.

The use of such a cutting apparatus would, however, lead to an increase in size of an apparatus in which the continuous sheet is processed. Moreover, the cutting apparatus may interfere with the continuous sheet being fed to cause jams or to damage the sheet. The movable and fixed cutting edges, furthermore, require periodical replacement, thus complicating maintenance and increasing cost.

SUMMARY OF THE INVENTION

The present invention was developed in consideration of these circumstances, and is intended to provide a sheet separating apparatus capable of separating a continuous sheet into a plurality of sheets without the use of a movable or fixed cutting edge, and effecting a simple construction and ease of maintenance.

In order to achieve the above object, the present invention is designed so that tension is applied to a continuous sheet having weakened lines arranged thereon at predetermined distances so that the continuous sheet is separated along the weakened lines. More specifically, according to the invention, there is provided a sheet separating apparatus which comprises first tensioning means for applying tension to the sheet along the longitudinal direction thereof; and second tensioning means for applying additional, non-uniform tension in the longitudinal direction along successive weakened lines while the sheet is being tensioned by the first tensioning means.

BRIEF DESCRIPTION OF THE DRAWINGS

FIGS. 5A and 5B are diagrams showing the first and second sides, respectively, of a transaction medium such as a cash card or the like;

DETAILED DESCRIPTION OF THE PREFERRED EMBODIMENT

An automatic bank note transaction apparatus using a sheet separating apparatus according to one illstrative, but non-limiting embodiment of the present invention will now be described in detail with reference to the accompanying drawings.

Figure 1:
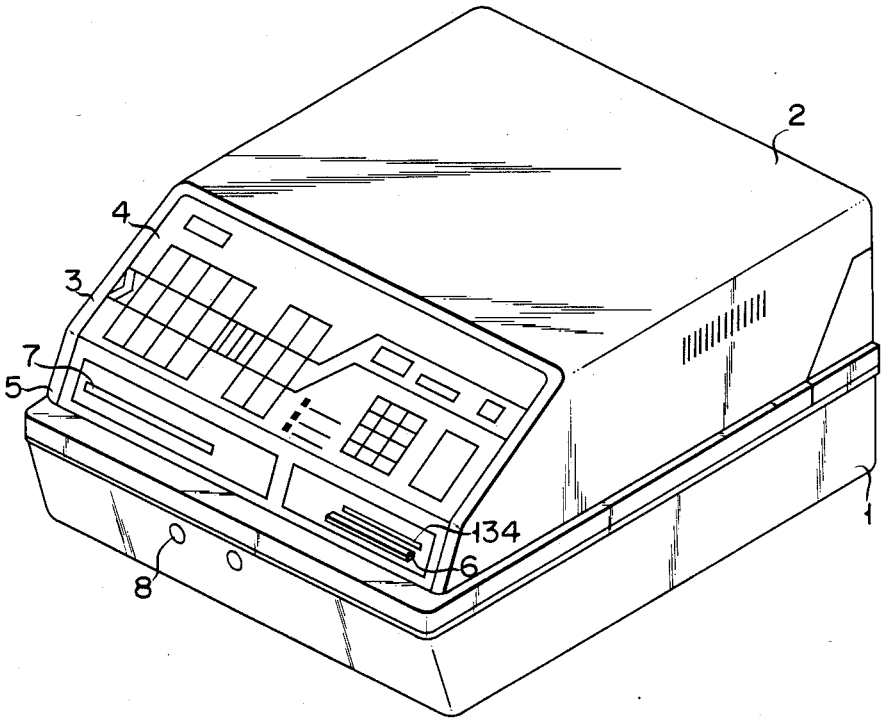
FIG. 1 is a perspective view showing a sheet separating apparatus according to one embodiment of the present invention applied to an automatic bank note transaction apparatus (automated teller machine)

First, an outline of the automatic bank note transaction apparatus will be described. In FIG. 1, numeral 1 designates a casing of the automatic bank note transaction apparatus. The top of the casing 1 is open. The casing 1 carries thereon a top cover 2 (described in detail later) which may be swung open to reveal the opening of casing 1. An operation guidance display unit 4 for customer guidance is provided on a front bevel section 3 of top cover 2. Arranged at a nose section 5 of top cover 2 are a card slot 6 through which a medium, e.g., a cash card issued by a bank, is inserted into or discharged from casing 1, and a bank note (cash) outlet slot 7 for delivering specified bank notes. A key 8 for locking the top cover 2 to casing 1 is provided at the lower front portion of casing 1. A receipt outlet slot 134 for issuing receipts is formed over card slot 6.

Figure 2:
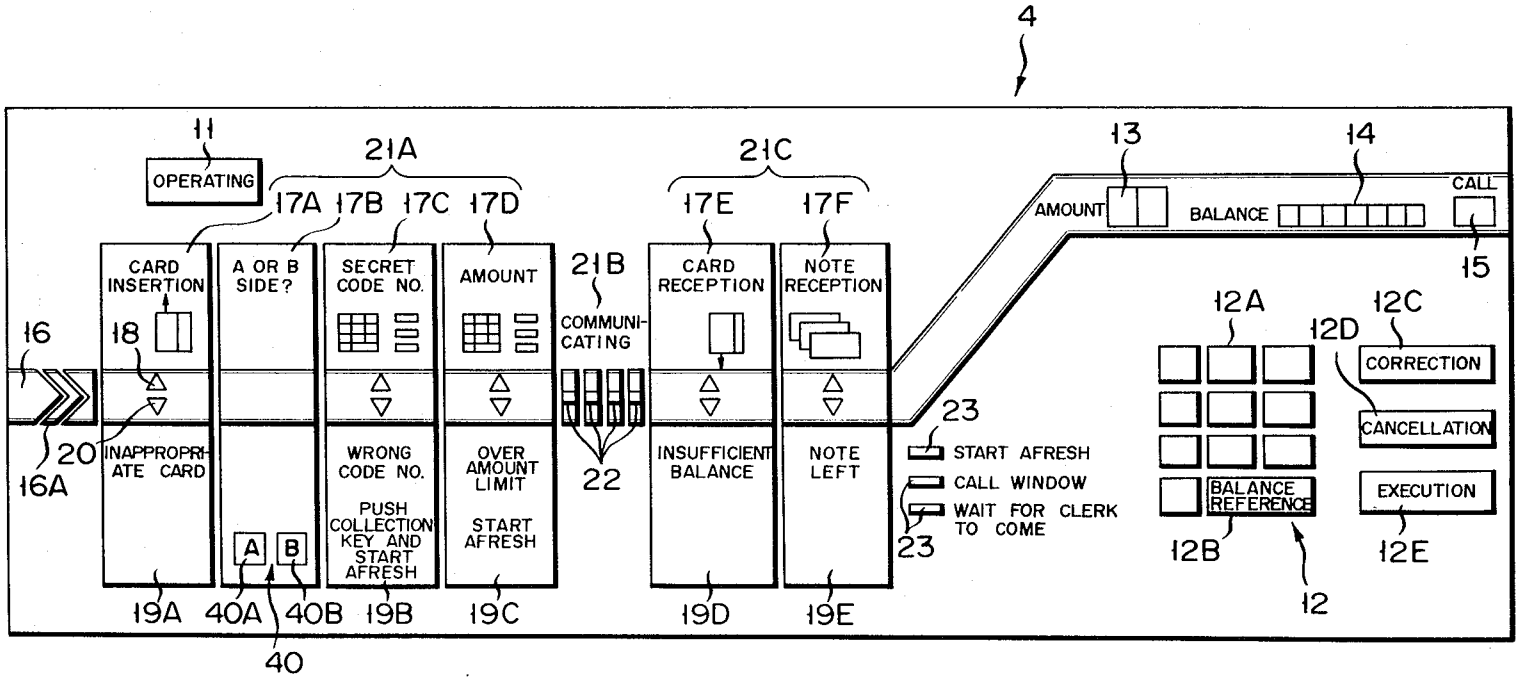
FIG. 2 is a front view of an operation guidance display unit of the automatic transaction apparatus.

Referring now to FIG. 2, a specific arrangement of the operation guidance display unit 4 will be described. An operating indicator 11 is attached to the upper left portion of display unit 4. When "OPERATING" is lit on indicator 11, the transaction apparatus is ready for a customer's operation. A keyboard 12 including ten keys is provided on the right end portion of display unit 4. Keyboard 12 consists of numeral keys 12A for amount input, a balance reference key 12B, a correction key 12C, a cancellation key 12D, and an execution key 12E. A set amount indicator 13, a balance indicator 14, and a call key 15 are arranged above keyboard 12.

As shown in FIG. 2, bevel section 3 has thereon a printed stripe 16 which extends horizontally in a straight line from the central portion of the left end to the middle of bevel section 3, and then turns into an upward slope which leads to another horizontal straight line including indicators 13 and 14 and call key 15 at the upper right end portion. A card insertion guidance frame 17A, a transaction selection guidance frame 17B, a secret code number guidance frame 17C, an amount guidance frame 17D, a card reception guidance frame 17E, and a note reception guidance frame 17F are successively arranged along the left-hand straight portion of stripe 16. Stripe 16 includes arrows 16A which indicate the direction of the operating sequence. The first four guidance frames 17A to 17D constitute an input guidance section 21A, while the last two guidance frames 17E and 17F form a reception guidance section 21C. The two guidance sections 21A and 21C are connected by an in-communication indicating section 21B.

Guidance frames 17A to 17F are each divided in two portions, one above and one below stripe 16. The upper portions of the guidance frames indicate normal operations, while the lower portions 19A to 19E give warnings against wrong operations. Stripe 16 also includes LEDs 18, each in the form of a triangle, and LEDs 20, each in the form of an inverted triangle. LEDs 18 indicate normal operations. However, if any of LEDs 20 is turned on, then the customer is warned of a wrong operation.

The in-communication indicating section 21B is composed of four column-shaped LEDs 22 arranged side-by-side. When the automatic bank note transaction apparatus is in communication with a host computer, the four LEDs 22 are flickered one after another to inform the customer of the progress of the communication. LEDs 23 are vertically arranged at the lower middle portion of the display unit 4, whereby the customer is given operating instructions against wrong operation or malfunction, i.e., "START AFRESH," "CALL WINDOW," and "WAIT FOR CLERK TO COME." For clearer distinction between the LEDs 18 and 20 in stripe 16, for example, the upward LEDs 18 for normal operation are green-colored, and the downward LEDs 20 for wrong operation are red-colored.

In the operation guidance display unit 4 described above, guidance frames 17A to 17F are arranged along stripe 16, following arrows 16A therein for indicating the course of the operating sequence, and the upward and downward LEDs 18 and 20 for indicating the normality or abnormality of operation are provided in all the guidance frames except the transaction selection guidance frame 17B. Thus, the operation is easy for the customer to understand and perform. In particular, the classification of the LEDs 18 and 20 by coloring further facilitates the operation, and is helpful to prevent improper operation.

Arranged in the lower half portion of the transaction selection guidance frame 17B below the stripe 16 are selection keys 40A and 40B, whereby the customer selects his desired transaction after inserting a transaction medium, e.g., a cash card (hereinafter referred to simply as a "card") into the transaction apparatus. The card preferably bears different transaction data on the two sides thereof. The selection keys 40A and 40B are operated to select the obverse (side A) and/or reverse (side B) of the card, respectively.

The division of the input and reception guidance sections 21A and 21C by the in-communication indicating section 21B further facilitates the customer's operation. As mentioned earlier, the four LEDs 22 are successively flickered while the transaction apparatus is in communication with a host computer. In the conventional transaction apparatus of this type, supplying bank notes for payment and slip processing are carried out simultaneously and require much time. It is, therefore, highly worthwhile to inform the customer of the progress of slip processing by flickering the LEDs 22. Set within the narrow stripe 16, the LEDs 18, 20 and 22 require only a relatively narrow space for a printed board and the like, and are low-priced. Instead of flickering the four LEDs 22, a single LED may be used for the same purpose.

Figure 3:
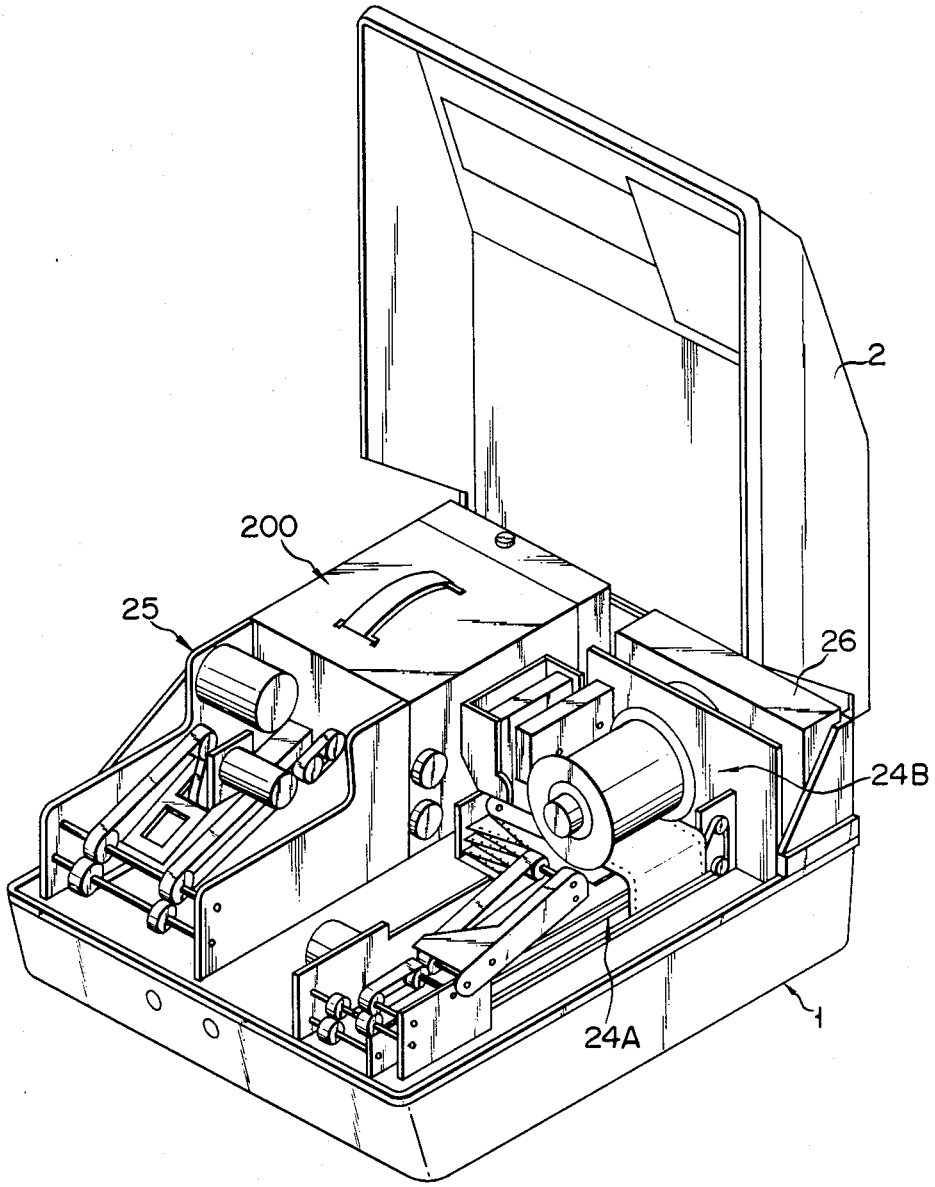
FIG. 3 is a perspective view showing the general internal layout of the automatic transaction apparatus.

Referring now to FIG. 3, the internal layout of the automatic bank note transaction apparatus of FIG. 1 will be described. A card processing unit 24A for processing the card inserted through the card slot 6 (see FIG. 1) is disposed in the inner part of casing 1 corresponding to card slot 6. Set behind card processing unit 24A is a slip processing unit 24B for recording transaction details and issuing receipts. Also, a payment note processing unit 25 for the delivery of bank notes and the like is provided corresponding to the bank note outlet slot 7 shown in FIG. 1. The payment note processing unit 25 is provided with a note storage box 200 for storing bank notes available to be disbursed to customers.

Top cover 2 can be swung up through approximately 90 degrees from casing 1. The note storage box 200 can be set in or removed from casing 1 when top cover 2 is in its open position, as shown in FIG. 3. Accordingly, if the automatic bank note transaction apparatus is placed on a shop counter or the like, a clerk in charge can readily set or remove the note storage box. Thus, the apparatus is greatly improved in operating efficiency. A control unit 26 for controlling the aforesaid units is disposed at the rear end portion of the interior of casing 1. Top cover 2, which is swingably attached to casing 1 by means of hinges (not shown), is held by a stopper (not shown) when it is in the open position.

Figure 4:
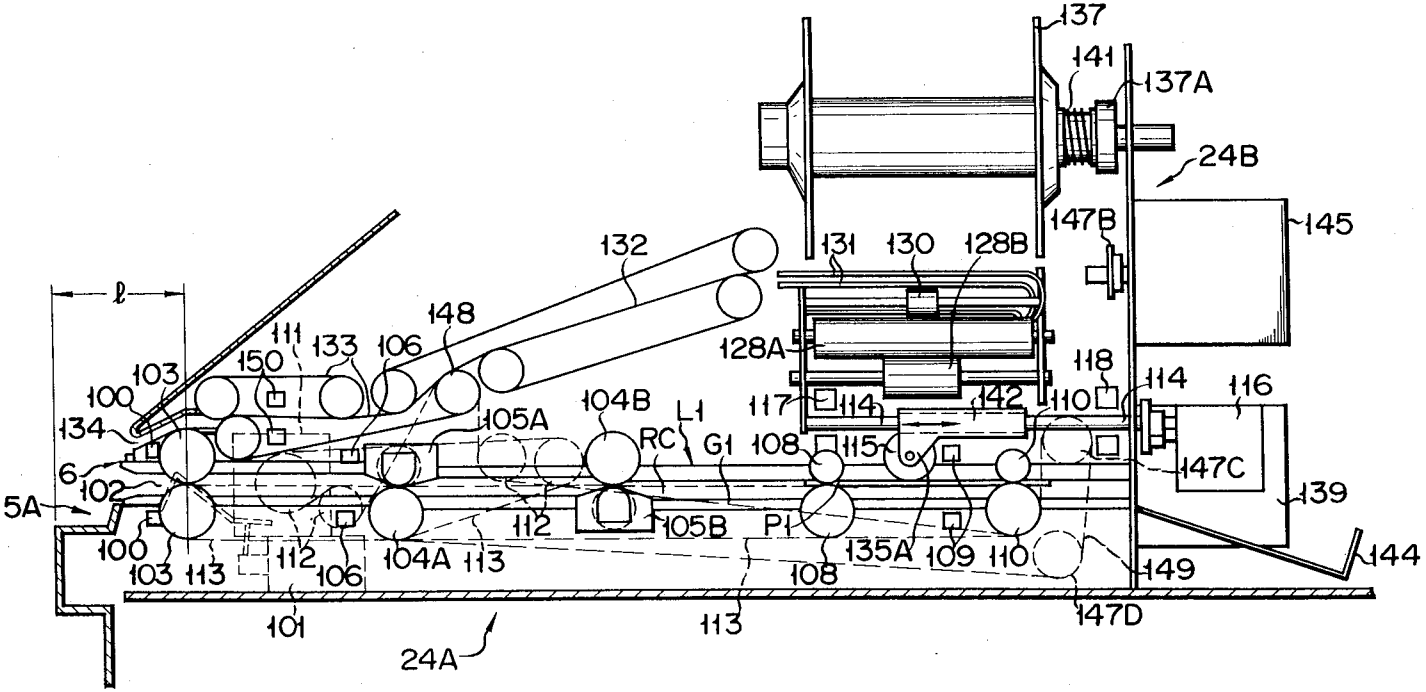
FIG. 4 is a side sectional view showing a card processing unit and a slip processing unit.
Figure 5A:
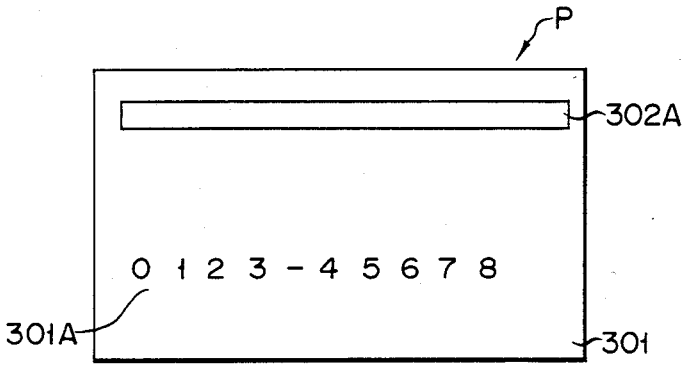
Figure 5B:
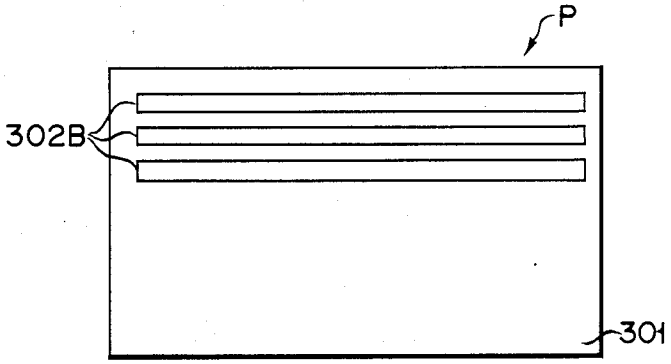

Referring now to FIGS. 4, 5A and 5B, the construction of card processing unit 24A will be described in detail. A pair of guides G1 are arranged in casing 1, whereby the two sides of the card inserted into casing 1 through card slot 6 are guided and supported. Also arranged in casing 1 are first, second, third, fourth and fifth conveyor roller pairs 103, 104A, 104B, 108 and 110 which hold and convey the card along guide pair G1. These guides and rollers constitute one illustrative example of transaction medium conveying means (hereinafter referred to simply as "card conveyor unit L").

A first detector 100 formed of a light emitting diode (LED) and a sensing element is disposed on the card slot side of card conveyor unit L1. Also, a second detector 106 formed of an LED and a sensing element is disposed just in front of the second conveyor roller pair 104A. Under the lateral portion of card conveyor unit L1 lies a solenoid 101 which is actuated in response to a signal (e.g., a signal from first detector 100) delivered when the card is put into the apparatus. A plunger of solenoid 101 is fitted at its distal end with a shutter 102 which normally closes card slot 6, and open slots 6 when solenoid 101 is excited.

Further, a first magnetic head 105A, for reading magnetic transaction information from the card is disposed along the axis (not shown) of the second conveyor roller pair 104A and over conveying path $R_C$ which is defined by the guide pair G1. First magnetic head 105A reads magnetic information from a magnetic stripe 302A (FIG. 5A) on the upper surface of the card delivered thereto. Likewise, a second magnetic head 105B, for reading additional magnetic transaction information on the card after the card has passed through the first magnetic head 105A, is disposed along the axis (not shown) of the third conveyor roller pair 104B and under conveying path $R_C$. Second magnetic head 105B reads magnetic information from magnetic stripes 302B (FIG. 5B) on the lower surface of the card delivered thereto.

The distance between first and second magnetic heads 105A and 105B is greater than the length of card P along the course of transfer thereof. This means that second magnetic head 105B can read the magnetic information on its corresponding surface of the card only after the card is read by first magnetic head 105A. Thus, first magnetic head 105A can perfectly be prevented from falling into an unsteady reading state attributed to an impact which acts on the card when the card gets into the nip portion between the third pair of conveyor rollers 104B to engage second magnetic head 105B.

At the rear end portion of card conveyor unit L1, a third detector 109 formed of an LED and a sensing element is disposed between fourth and fifth conveyor roller pairs 108 and 110.

The distance "l" between the nose portion of casing 1 and the center of first conveyor roller pair 103 is greater than the length of the card, so that the rear end of the card is located within a recessed portion 5A when the front end is held between the two conveyor rollers 103. A drive system for card conveyor unit L1 is composed of a pulse motor 111 and transmission means which includes a group of timing pulleys 112 and a group of timing belts 113 for transmitting driving force from pulse motor 111 to conveyor rollers 103, 104A, 104B, 108 and 110.

Referring now to FIGS. 5A and 5B, the card used in the present embodiment will be described. FIGS. 5A and 5B show the obverse and reverse, respectively, of card P as a transaction medium. The two sides bear thereon different pieces of transaction information, e.g., magnetic information based on two different standards currently used in the financial and credit business worlds of Japan. As shown in FIG. 5A, card P consists of a card base 301 made of resin or the like. A single magnetic stripe 302A bearing data based on JIS-B-9560 type II, or the like, used in the financial business world is formed on the obverse of base 301. As shown in FIG. 5B, on the other hand, three magnetic stripes 302B bearing data based on JIS-B-9560 type I, or the like, used in the credit business world are formed on the reverse of card base 301. Also, an embossment mark 301A is formed on the obverse of card P, representing visible information such as the as the corresponding bank's branch number, customer's account number, etc.

Figure 6:
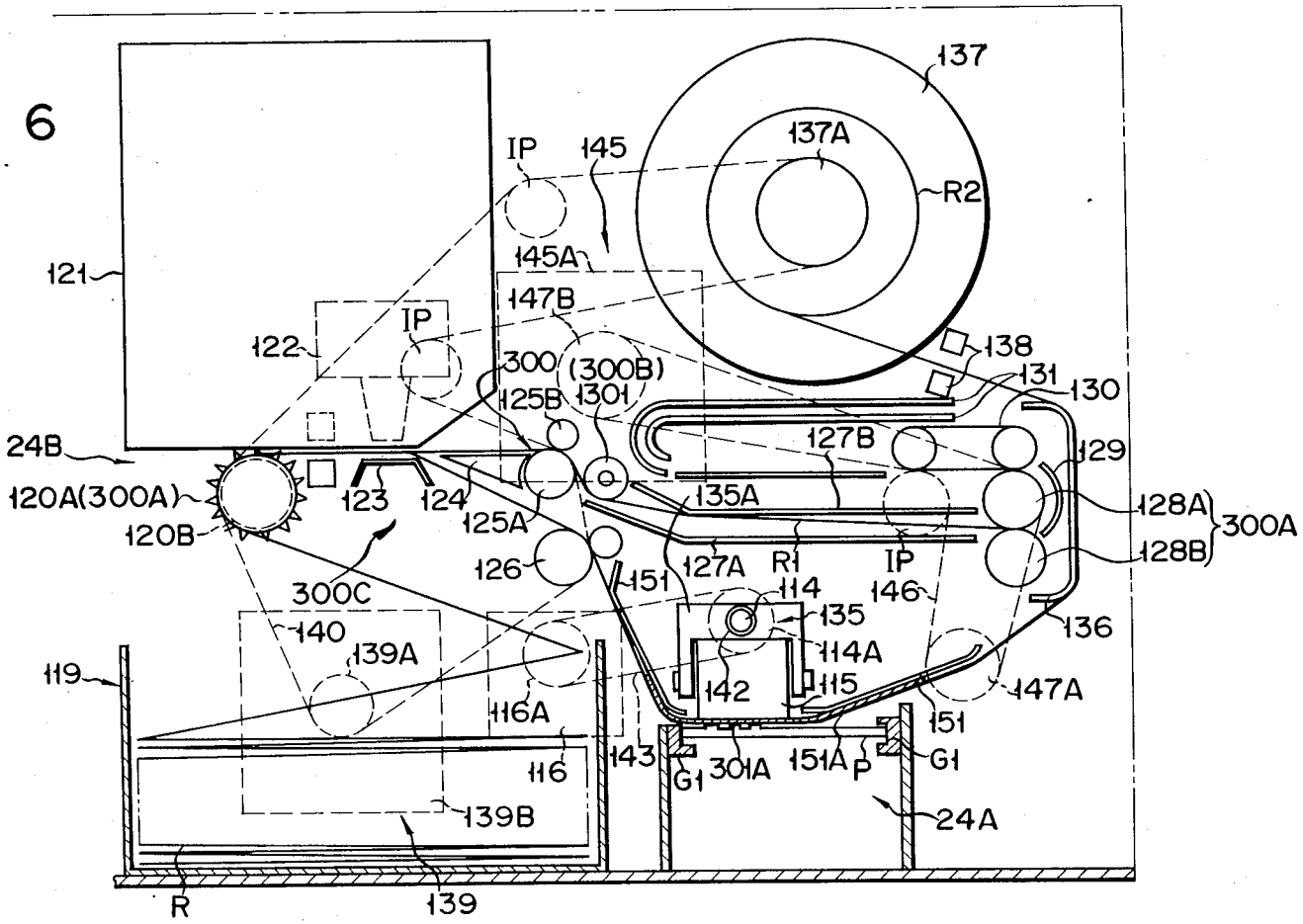
FIG. 6 is a front sectional view of the slip processing unit.
Figure 7:
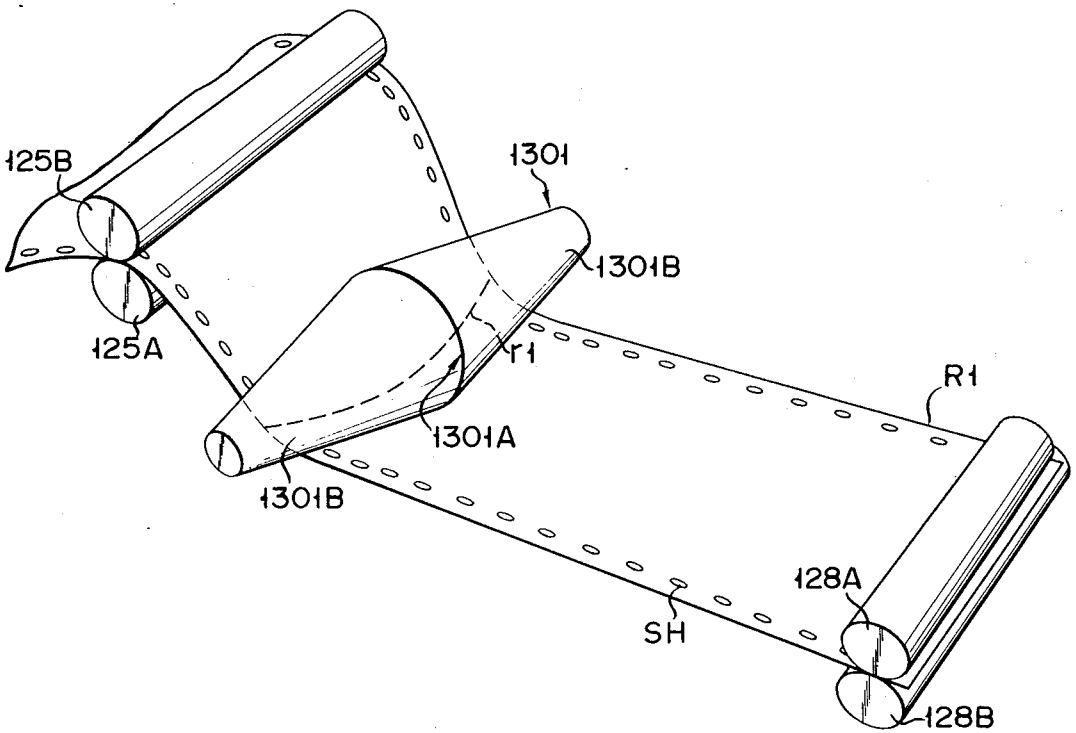
FIG. 7 is an enlarged perspective view showing a spindle-shaped guide roller for use in a sheet separating apparatus incorporating the teachings of the subject invention.

Referring now to FIGS. 4, 6 and 7, the construction of slip processing unit 24B will be described in detail. In FIG. 6, a slip storage box 119 is set in casing 1. Slip storage box 119 stores therein a slip sheet R on which details of transactions are to be recorded. The slip sheet R is formed of both receipt paper R1 and journal paper R2. The receipt paper R1 and the journal paper R2 are joined together and folded in layers at regular intervals. A plurality of sprocket holes SH are formed along each side edge of slip sheet R, arranged at regular intervals. A sprocket wheel 120A is disposed over the opening of slip storage box 119. Slip sheet R is fed as sprocket wheel 120A rotates with its sprocket teeth engaging sprocket holes SH of slip sheet R.

A printing unit 121 with a printing head 122 is provided above sprocket wheel 120A. In printing, slip sheet R is held between printing head 122 and a platen 123 which faces the extreme end of printing head 122. A splitting plate 124 adjoins platen 123, whereby receipt paper R1 and journal paper R2 of the slip sheet R are separated from each other.

Perforations r1 (FIG. 7) are formed along each fold of receipt paper R1 and extend across the whole width thereof. In other words, the perforations r1 are arranged at right angles to the longitudinal direction of receipt paper R1. The perforations r1 on each fold constitute weakened lines in receipt paper R1.

A sheet separating apparatus 300, according to one embodiment of the present invention, is provided on the side of receipt paper R1 removed from journal paper R2 by splitting plate 124, whereby receipt paper R1 is separated along each series of perforations r1 (see FIG. 7) with every transaction. Sheet separating apparatus 300 comprises a first tensioning mechanism 300A for pulling receipt paper R1 in the longitudinal direction to apply tension thereto, and a second tensioning mechanism 300B for applying non-uniform tension to receipt paper R1 pulled by first tensioning mechanism 300A.

Slip processing unit 24B is further provided with a conveyor system 300C for feeding receipt paper R1. Conveyor system 300C at least includes sprocket wheel 120A, a first roller pair 125A and 125B, a second roller pair 128A and 128B, and a pair of guide plates 127A and 127B for leading the forward end of receipt paper R1 delivered from first roller pair 125A and 125B to second roller pair 128A and 128B (described in detail later).

First tensioning mechanism 300A includes sprocket wheel 120A, a first drive mechanism 139 for driving sprocket wheel 120A, second roller pair 128A and 128B, and a second drive mechanism 145 for driving second roller pair 128A and 128B. First drive mechanism 139 applies a longitudinal tension to receipt paper R1 by stopping sprocket wheel 120A or driving it so that receipt paper R1 is fed at a speed lower than the speed at which receipt paper R1 is transferred as a result of second roller pair 128A and 128B being rotated by second drive mechanism 145.

Out of the first roller pair for feeding receipt paper R1, roller 125A is a driving roller connected to drive mechanism 139, while roller 125B is a pinch roller. In this embodiment, first roller pair 125A and 125B and second roller pair 128A and 128B are spaced at a distance shorter than the distance or arrangement pitch of perforations r1 in receipt paper R1. Out of the second roller pair, roller 128A is a driving roller connected to the second drive mechanism 145, while roller 128B is a pitch roller.

As shown in FIGS. 6 and 7, second tensioning mechanism 300B is formed of a guide roller 1301 which is located in a fixed position between first roller pair 125A and 125B and second roller pair 128A and 128B. Guide roller 1301 has a contact surface which touches the central portion of receipt paper R1 passed between first roller pair 125A and 125B and second roller pair 128A and 128B. Namely, as shown in FIG. 7, the guide roller 1301 is a spindle-shaped roller which has a central portion (ring-shaped edge) 1301A with the largest diameter and taper portions 1301B gradually reduced in diameter toward each end. The guide roller 1301 is positioned so as to cross the receipt paper R1 at right angles to the longitudinal direction thereof. In other words, the guide roller 1301 has a contact portion (central portion 1301A) in contact with the central portion of the receipt paper R1 and uncontacted surfaces (taper portions 1301B) not in touch with the receipt paper R1.

Guide roller 1301 is set in a position such that a first series of perforations r1 is in contact with central portion 1301A when the forward end of receipt paper R1 is held between second roller pair 128A and 128B. Also, guide roller 1301 is positioned so that receipt paper R1 between first roller pair 125A and 125B and second roller pair 128A and 128B is in contact with central portion 1301A of guide roller 1301 at a predetermined contact angle; that is, the receipt paper R1 is bent. As is shown in FIG. 6, receipt paper R1 contacts guide roller 1301 on the side of guide roller 1301 that provides the greater receipt paper curvature, that is, the lower side. As is further seen in FIG. 6, the axis of rotation of guide roller 1301 is displaced from an imaginary plane connecting the nip portion between the rollers off first roller pair 125A, 125B and the nip portion between the rollers of second roller pair 128A, 128B in a direction perpendicular to that imaginary plane. Receipt paper R1 contacts the side of guide roller 1301 that deflects receipt paper R1 from the imaginary plane in the same direction that the axis of guide roller 1301 is displaced. With such location and configuration of guide roller 1301, receipt paper R1 longitudinally stretched by the first tensioning mechanism 300A is pressed against guide roller 1301 so that only the central portion of receipt paper R1 is in contact with central portion 1301A of guide roller 1301. Thus, the tension is increased expressly at the central portion of receipt paper R1. Accordingly, receipt paper R1 starts to be separated at perforations r1 in the central portion in contact with guide roller 1301. The separation gradually spreads toward each side edge of receipt paper R1, and finally, receipt paper R1 is cut along the series of perforations r1.

Out of the pair of guide plates 127A and 127B for guiding receipt paper R1 between first roller pair 125A and 125B and second roller pair 128A and 128B, the upper guide plate 127B is rockable supported at its end portion on the side of the second roller pair 128A and 128B. On the other hand, the lower guide plate 127A is fixed. When receipt paper R1 is not held between guide plates 127A and 127B, upper guide plate 127B engages as a result of gravity a stopper (not shown) in a position near the lower guide plate 127A. In this state, the distance between the two guide plates 127A and 127B is narrow, and the forward end of receipt paper R1 is securely guided to second roller pair 128A and 128B. When a longitudinal tension is applied to receipt paper R1 by the first tensioning mechanism 300A, receipt paper R1 is stretched tight. At this time, upper guide plate 127B, which is supported in a rockable manner, will not prevent the tensioning of receipt paper R1.

Curved guide 129 is disposed behind second roller pair 128A and 128B, whereby the course of a receipt separated from receipt paper R1 by sheet separating apparatus 300 is changed at an angle of 180 degrees. A receipt guided by curved guide 129 is turned at 90 degrees (in the direction perpendicular to the drawing plane) by a conveyor belt 130 and a turn guide pair 131, and is then transferred toward the front portion of the transaction apparatus. Discharging belt systems 132 and 133 (FIG. 4) are arranged for conveying a receipt turned by turn guide pair 131 to the receipt outlet slot 134. Discharging belt system 133 is provided with a receipt detector 150 for optically detecting the receipt to be discharged.

A pair of journal guide rollers 126 are provided on side of the journal paper R2 split from slip sheet R by splitting plate 124. A embossment imprinter 135 is disposed behind guide rollers 126, whereby journal paper R2 is imprinted with the embossment mark 301A on card P delivered from card processing unit 24A. Embossment imprinter 135 is provided with a pair of journal guides 151 spaced over the conveying path for card P defined by guide pair G1 of card processing unit 24A. The pair of journal guides 151 define a conveying path for journal paper R2. A flexible sheet 151A (e.g., polyester sheet about 0.1 mm to 0.2 mm thick or spring steel sheet about 50 microns thick) is stretched between the two journal guides 151. The journal paper R2 being fed is located between flexible sheet 151A and card P.

An embossing roller (covered with rubber) 115 is rotatably supported by a holder 135A over flexible sheet 151A between journal guides 151. As shown in FIGS. 4 and 6, holder 135A is fitted with a lead screw nut 142. A lead screw shaft 114 is rotatably fitted in lead screw nut 142. As lead screw shaft 114 is rotated in either direction, embossing roller 115 reciprocates together with holder 135A along the card transfer direction. As shown in FIG. 4, holder position detectors 117 and 118 for detecting the position of holder 135A are arranged individually on both end sides of lead screw shaft 114.

Embossment imprinter 135 is followed by a turn guide 136 for guiding and changing the course of journal paper R2 with the information from card P thereon, and a journal take-up unit 137 for winding up the turned journal paper R2. As shown in FIG. 6, a journal cut detector 138 for optically detecting any cut of journal paper R2 is arranged across journal paper R2.

Referring now to FIGS. 4 and 6, the construction of a drive system for conveyor system 300C of slip processing unit 24B will be described. A drive motor (pulse motor) 139B for slip feed is attached to the lower side portion of slip storage box 119. A first timing belt 140 is stretched between a timing pulley 139A on the rotating shaft of drive motor 139B, a timing pulley 137A on the rotating shaft of journal take-up unit 137, a timing pulley 120B on the rotating shaft of sprocket wheel 120A, a timing pulley (not shown) on the rotating shaft of roller 125A, a timing pulley (not shown) on the rotating shaft of a journal guide roller 126, and several idle timing pulleys IP. The driving force of pulse motor 139B is transmitted to the pulleys and rollers by first timing belt 140. All those elements constitute the first drive mechanism 139.

A torque limiter 141 provided on the right side of journal take-up unit 137, as shown in FIG. 4, is adapted to slip so that the journal paper is wound up smoothly when the winding speed is increased. A drive motor 145A for receipt feed is provided beside printing unit 121. A second timing belt 146 is stretched between a timing pulley 147B on the rotating shaft of drive motor 145A, a timing pulley (not shown) on the shaft of the one roller 128A of the second roller pair, a timing pulley 147A, and an idle pulley IP. The driving force of drive motor 145A is transmitted to the pulleys and rollers by second timing belt 146. All those elements constitute the second drive mechanism 145.

A drive motor 116 for the lead screw shaft 114 of embossment imprinter 135 is provided on the right of drive motor 139B for slip feed as shown in FIG. 6, whereby lead screw shaft 114 is rotated to reciprocate embossing roller 115 in the horizontal direction of FIG. 4. A third timing belt 143 is stretched between a timing pulley 116A on the rotating shaft of drive motor 116 and a timing pulley 114A on lead screw shaft 114. The driving force of drive motor 116 is transmitted to embossing roller 115 by third timing belt 143. The rotation of timing pulley 147A shown in FIG. 6 is transmitted to a driving pulley 147C shown in FIG. 4 through a rotation transmitting direction changing mechanism (not shown) such as a bevel gear pair for changing the direction of rotation transmission by 90 degrees. This rotation is transmitted to a driving roller 148 of discharging belt system 133 by means of a group of idle pulleys 147D and a timing pulley 149, whereby the discharging belt systems 132 and 133 are driven.

The functions of card processing unit 24A and slip processing unit 24B of the above-mentioned constructions will now be described.

When card P is inserted through card slot 6, first detector 100 detects the forward end of card P, so that solenoid 101 is excited to open shutter 102. If card P is further pushed in, first conveyor roller pair 103 rotates to feed card P along card conveyor unit L1. Then, card P is transferred by second conveyor roller pair 104A. If card P used here is based on JIS-B-9560 type II (with magnetic information on the obverse of the card), first magnetic head 105A on the upper side reads magnetic information from magnetic stripe 302A of card P. If card P is based on JIS-B-9560 type I (with magnetic information on the reverse of the card), card P passes by first magnetic head 105A without engaging the same, and is then transferred by third conveyor roller pair 104B so that second magnetic head 105B on the lower side reads the magnetic information from magnetic stripes 302B of card P. Moreover, if different pieces of transaction information are recorded on the two sides of card P, as described in connection with FIGS. 5A and 5B, the magnetic data on the obverse and reverse of card P may be successively read by first and second magnetic heads 105A and 105B.

Thus, in reading the magnetic information from the obverse or reverse or from both sides of card P, the distance between first and second magnetic heads 105A and 105B is set to be greater than the length of card P along the course of transfer thereof. This means that second magnetic head 105B can read the magnetic information on its corresponding surface of the card P only after card P is read by first magnetic head 105A. Thus, first magnetic head 105A can be prevented from falling into an unsteady reading state attributed to an impact which acts on the card when it gets into the nip portion between the third pair of conveyor rollers 104B used to engage second magnetic head 105B.

Once the magnetic information is read from both sides of the card P, the customer's desired transaction data can be read in accordance with transaction instructions given through the operation guidance display unit 4.

If card P is read correctly, it goes on being transferred. Thereafter, the forward end of the card P is detected by third detector 109, when card P is temporarily stopped at a predetermined position P1 (see FIG. 4). Since pulse motor 111 is used as the drive source for the transfer of card P, the stop position of the card P is secured by controlling the number of pulses sent to motor 111.

As shown in FIG. 6, slip sheet R has a two-ply structure, and is folded in layers along each series of perforations r1. As sprocket wheel 120A rotates, the two-ply slip sheet R is drawn out and fed between printing head 122 and platen 123 of printing unit 121 for printing. After passing through printing unit 121, slip sheet R is separated by splitting plate 124 into receipt paper R1 to be delivered to customers and journal paper R2 to be wound on journal take-up unit 137 as a transaction record. Receipt paper R1 is fed from first roller pair 125A and 125B to second roller pair 128A and 128B shown in FIG. 6.

Immediately after the forward end of receipt paper R1 reaches second roller pair 128A and 128B to be held between them, drive roller 139B for slip feed is stopped, so that the rotation of sprocket wheel 120A is stopped. On the other hand, drive motor 145A for receipt feed goes on rotating without a stop, so that second roller pair 128A and 128B continue to rotate. Thereupon, the longitudinal tension on receipt paper R1 is increased gradually. As the tension increases, receipt paper R1 comes closer to contact surface 1301A of spindle-shaped guide roller 1301. In other words, receipt paper R1 is bent at the central portion both along the transfer direction thereof and along the width thereof, as shown in FIG. 7. Thus, the tension applied to receipt paper R1 by the guide roller 1301 along the transfer direction becomes non-uniform across the width of the paper; and maximum tension acts substantially on the center of the width of receipt paper R1. Accordingly, receipt paper R1 starts to be torn at the central portion of the series of perforations r1, and a receipt in the form of a simple slip bearing the details of the transaction concerned is separated from receipt paper R1 along the series of perforations r1.

The separated receipt is delivered to receipt outlet slot 134 via curved guide 129, turn guide pair 131, and discharging belt systems 132 and 133. Since the receipt can be separated from receipt paper R1 without using any conventional cutter means (e.g., fixed and movable cutting edges), the mechanism for the receipt separation can be simplified in construction, and the receipt can be protected against jam attributed to contact with a cutter means. Moreover, there is no need for periodical replacement of any cutter means, so that maintenance is easy.

Meanwhile, journal paper R2 split from slip sheet R by splitting plate 124 is imprinted with embossment mark 301A (see FIG. 6) from an embossed portion of card P by embossment imprinter 135, and is then wound up by journal take-up unit 137. The predetermined position P1 for the temporary stop of card P is defined as an embossment position.

According to embossment imprinter 135 of the transaction apparatus of the present invention, as shown in FIG. 6, flexible sheet 151A is disposed between the two journal guides 151 so that journal paper R2 in imprinter 135 is guided entirely flat. Thus, journal paper R2 can perfectly be prevented from being jammed or damaged between the two journal guides 151. In the embossment printing, moreover, flexible sheet 151A is interposed between embossing roller 115 and journal paper R2. If the top end faces of embossment mark 301A are subject to differences in level or unevenness, flexible sheet 151A can absorb the unevenness of mark 301A. Thus, the embossing pressure from embossing roller 115 uniformly acts on journal paper R2, ensuring the production of a clear-cut embossed print.

In discharging card P, it is returned to card slot 6 by reversing the aforementioned route. If the information on card P is read and this information indicates that card P is invalid, card P should be removed from public circulation. In this case, card P when located in the position P1 of FIG. 4 is further advanced by the drive of pulse motor 111, and is delivered to a recovery chute 144 to be collected therefrom. However, if card P is valid and to be returned to the user, the forward end of card P is returned to card slot 6 without being fully withdrawn, but instead remains located within recessed portion 5A (see FIG. 4) inside the forefront of casing 1. Thus, card P is prevented from being pushed against any part of the customer's body and thereby damaged.

Figure 8:
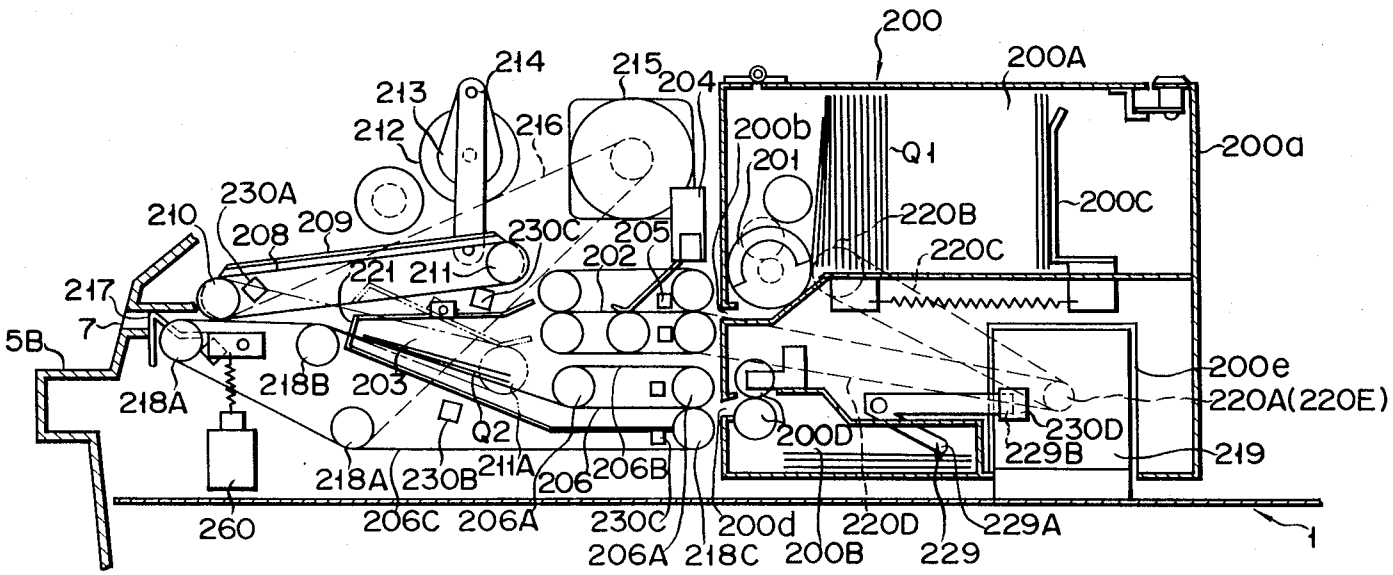
FIG. 8 is a side sectional view showing a payment note processing unit.

Referring now to FIG. 8, the construction of payment note processing unit 25 will be described in detail. As described with reference to FIG. 3, bank note storage box 200 is located in a position such that it can be set in or removed from casing 1 when top cover 2 is in its open position. In order to maintain the position of bank note storage box 200 in casing 1, a lock member (not shown) for detachably locking bank note storage box 200 to casing 1 is attached to that portion of casing 1 under storage box 200. Bank note storage box 200 is integrally formed of a payment note storage section 200A for storing bank notes to be paid to customers, and a withdrawn note storage section 200B for storing rejectable notes (including superposed notes, counterfeit notes, etc.) or those notes which the customer has failed to recover and are to be withdrawn.

The payment note storage section 200A is formed in the upper inside space of a housing 200*a* of bank note storage box 200. A pile of bank notes Q1 are arranged in a vertical position in the storage section 200A. The rear end portion (on the right side of FIG. 8) of note pile Q1 is pushed forward by a backup plate 200C. A takeout roller 201 is provided on the front end side (left side of FIG. 8) of pile Q1. Bank notes Q1 are delivered one by one with every revolution of takeout roller 201. A leading bank note at the front end of pile Q1 is pressed against takeout roller 201 by backup plate 200C. As takeout roller 201 is rotated, each bank note is delivered to a bank note discharge slot 200*b*.

The withdrawn note storage section 200B is formed at the lower front portion of housing 200*a* of bank note storage box 200. Withdrawn note storage section 200B is provided with an inlet roller pair 200D for introducing those bank notes delivered to a note inlet slot 200*d* into storage section 200B. Withdrawn note storage section 200B is further provided with a movable member, such as an actuator 229 which has a contact end 229A to engage the top surface of a pile of withdrawn bank notes and is rockably mounted on housing 200*a* of bank note storage box 200, whereby the number of the bank notes collected in storage section 200B is detected. Also, storage section 200B is provided with a detector 230D which is fixedly arranged in casing 1. Detector 230D is formed of an LED and a sensing element facing each other with a to-be-detected end 229B (namely, the other end of the actuator 229) therebetween, whereby the to-be-detected end 229B is optically detected. Here actuator 229 is located within housing 200*a* of bank note storage box 200, while detector 230D is fixed inside casing 1 of the transaction apparatus. Therefore, actuator 229 and detector 230D can detect not only the number of withdrawn notes, but also the condition of bank note storage box 200 (e.g., the presence of the storage box at the start of the operation of the transaction apparatus, trouble due to robbery, etc.).

A drive motor 210 for driving takeout roller 201 is mounted on casing 1. An indentation 200*e* is formed in housing 200*a* of bank note storage box 200 to avoid interference with drive motor 219. The rotation of timing pulley 220A mounted on the shaft of drive motor 219 is transmitted to a driving pulley 220B by a timing belt 220C. The rotation of driving pulley 220B is transmitted to takeout roller 201 through a spur gear (not shown) mounted on the rotating shaft of pulley 220B and a driving gear (not shown) mounted on the rotating shaft of takeout roller 201 and in mesh with the spur gear.

A bank note conveying path 202 is defined by a group of rollers and belts located on the side of storage box 200 where the bank notes are taken out one by one from payment note storage section 200A. In bank note conveying path 202, the bank notes are carried by a belt 220D which is passed around a timing pulley 220E on the rotating shaft of drive motor 219. Superpositioned on bank note conveying path 202 is a detector 204 which detects the presence of superposed notes by determining the thickness of the bank notes. Also, a counting detector 205 for counting the delivered bank notes is disposed on conveying path 202. Conveying path 202 is followed by a temporary collecting section 203, which successively collects the bank notes delivered thereto (collected notes are indicated by Q2).

A rejectable note conveying path 206 formed of a conveyor roller 206A and a belt 206B is provided below conveying path 202. Further a belt 206C is stretched between driving rollers 218A and guide rollers 218B and 218C so that a part of belt 206C is in contact with the underside of belt 206B of the rejectable note conveying path 206. Thus, bank notes are temporarily collected on conveyor belt 206C. Temporary collecting section 203 is covered by a rocking guide 221 which trues up the edges of the collected notes and rocks to open the outlet side of temporary collecting section 203 at the time of delivery.

A driving roller 210 is disposed in contact with that portion of belt 206C which adjoins bank note outlet slot 7. A conveyor belt 208 is stretched between driving roller 210 and a roller 211 which is disposed over temporary collecting section 203. The two rollers 210 and 211 are coupled together by a swinging arm 209 which can swing around the rotating shaft of roller 210. Swinging arm 209 is fitted with a link mechanism which includes a coupling link 214, a crank 213, and a drive motor 212. As the link mechanism is actuated, roller 211 is moved to a position 211A indicated by a dotted line in FIG. 8, where it is pressed against conveyor belt 206C at temporary collecting section 203. Thus, collected notes Q2 can be transferred between the two belts 206C and 208.

Driving rollers 210 and 218A are rotated by a pulse motor 215 with the aid of a driving belt 216. The running direction of belts 208 and 206C can be changed by reversing the rotation of pulse motor 215. If pulse motor 215 is driven in the counterclockwise direction of FIG. 8, bank notes Q2 collected in temporary collecting section 203 are transferred toward bank note outlet slot 7. If pulse motor 215 is driven in the clockwise direction, on the other hand, notes remaining in bank note outlet slot 7 are carried toward withdrawn note storage section 200B with the additional aid of belt 206B.

A shutter 217 is swingably disposed in the vicinity of bank note outlet slot 7. Shutter 217 serves to open and close bank note outlet slot 7, controlled by a solenoid 260. When solenoid 260 is excited in accordance with a payment signal from control unit 26, shutter 217 is opened. In FIG. 8, numerals 230A, 230B and 230C designate detectors in various positions which are each formed of an LED and a sensing element. Bank note outlet slot 7 is located within recessed portion 5B at the forefront of casing 1 lest the bank notes in slot 7 project beyond the forefront of casing 1.

The function of payment note processing unit 25 will now be described. The pile of bank notes Q1 previously set in payment note storage section 200A are separately picked up one by one by takeout roller 201, passed through conveying path 202, and collected in temporary collecting section 203 until a predetermined number are so collected. Superposition detector 204 measures the thickness of the bank notes, and converts the result of this measurement into an electric signal, thereby detecting the presence of superposed notes.

If a thickness exceeding the expected value is detected, detector 204 delivers a superposition signal. Upon receiving the superposition signal, control unit 26 stops takeout roller 201, and starts a rejecting operation. In the rejecting operation, swinging arm 209 is swung by the link mechanism, as mentioned before. Thereupon, roller 211 is pressed against belt 206C at temporary collecting section 203 to feed the rejectable bank notes reversely. The rejectable bank notes are collected in withdrawn note storage section 200B of bank note storage box 200 via rejectable note conveying path 206. Thus, delivery of superposed notes is securely prevented, in a manner whereby counting detector 205 can avoid counting errors.

If no superposed notes are detected, the specified number of bank notes are fed toward bank note outlet slot 7, held between the conveyor belts 208 and 206C. Thereupon, rocking guide 221 for truing up the edges of the bank notes is opened, and shutter 217 is opened in the aforementioned manner, so that the bank notes are delivered to bank note outlet slot 7. At this time, the rear ends of the bank notes are held between conveyor belts 206C and 208 in a manner such that the greater part of each bank note projects outward from bank note outlet slot 7. In this state, if the customer leaves the bank notes in outlet slot 7 as they are for a given time, conveyor belts 206B, 206C and 208 are driven reversely so that the left notes are collected in withdrawn note storage section 200B of bank note storage box 200.

It is to be understood that the present invention is not limited to the one embodiment described above, and that various changes and modifications may be effected wherein by one skilled in the art without departing from the scope or spirit of the invention.

In the above embodiment, for example, first and second conveying means are each formed of a sprocket wheel and roller pairs. Alternatively, however, conveying means may be formed of a pair of endless belts facing each ther. In the above embodiment, longitudinal tension on a continuous sheet between the two conveying means is increased by stopping the first conveying means. However, either of the conveying means need not always be stopped for this purpose. It is necessary only that the relative sheet transfer speeds ($V_1$, $V_2$) of the two conveying means be made different to apply tension to the continuous sheet.

Figure 9:
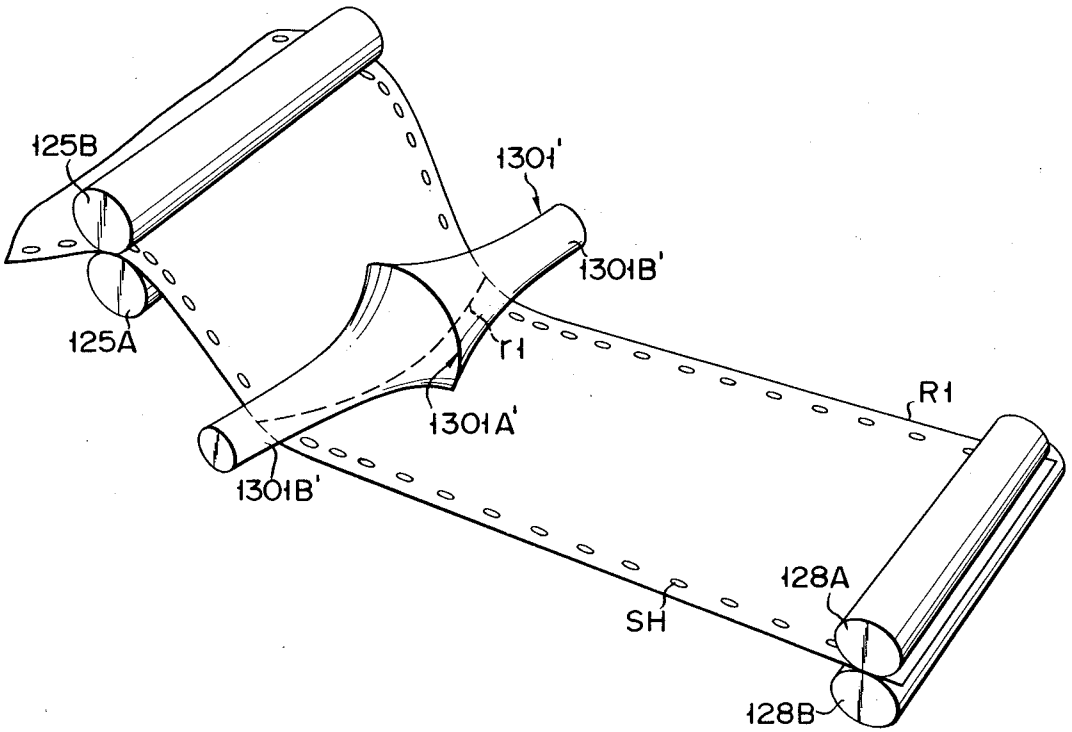
FIG. 9 is a perspective view showing another embodiment of a guide roller for use in a sheet separating apparatus incorporating the teachings of the subject invention.
Figure 10:
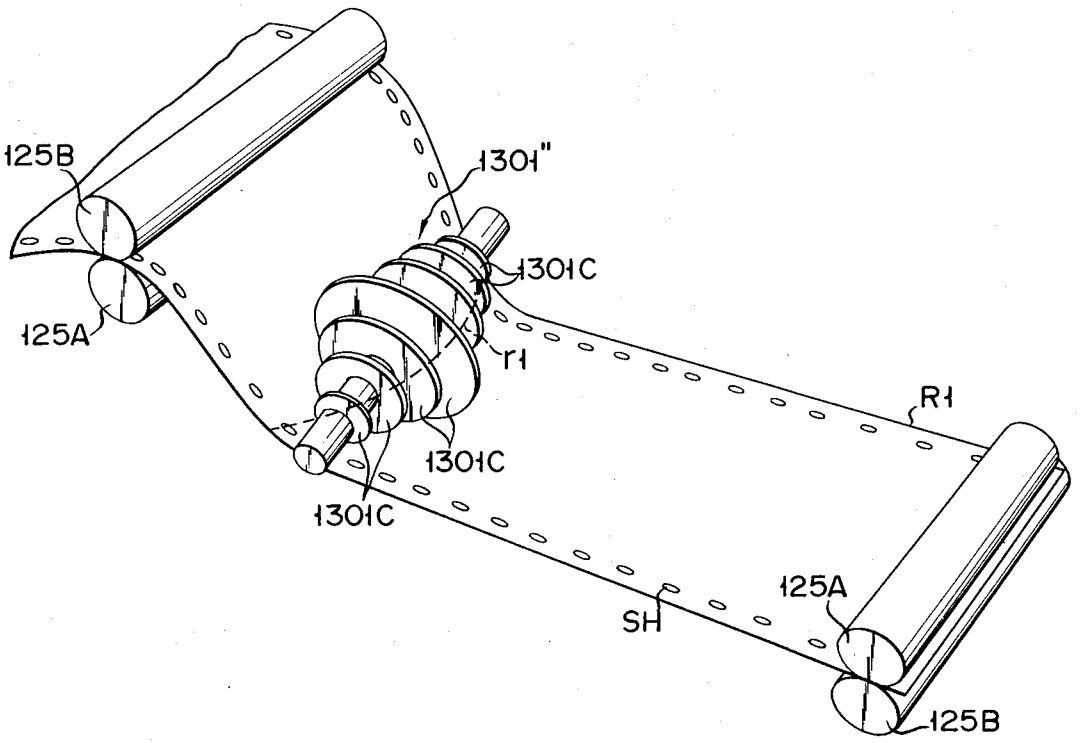
FIG. 10 is a perspective view showing still another embodiment of a guide roller for use in a sheet separating apparatus incorporating the teachings of the subject invention.

In the above embodiment, moreover, the guide member having a contact portion in contact with at least part of the continuous sheet held between the first and second conveying means is formed of a spindle-shaped roller. As shown as a first modification in FIG. 9, however, the guide member 1301 may be a chevron-shaped fixed guide roller 1301' which is made of a low-friction material such as resin, and has a contact portion 1301A' and uncontacted surfaces 1301B' extending on each side thereof so as to be narrowed toward each end of the guide roller. As shown as a second modification in FIG. 10, moreover, a plurality of thin rollers 1301C may be combinedly arranged in the form of a spindle or guide roller 1301'.

Further, the weakened lines are not limited to a series of perforations, and may be formed of a simple fold. The continuous sheet with the weakened lines arranged at regular distances thereon is not limited to journal paper, and may be a sheet for any other suitable application with or without sprocket holes.

Figure 11:
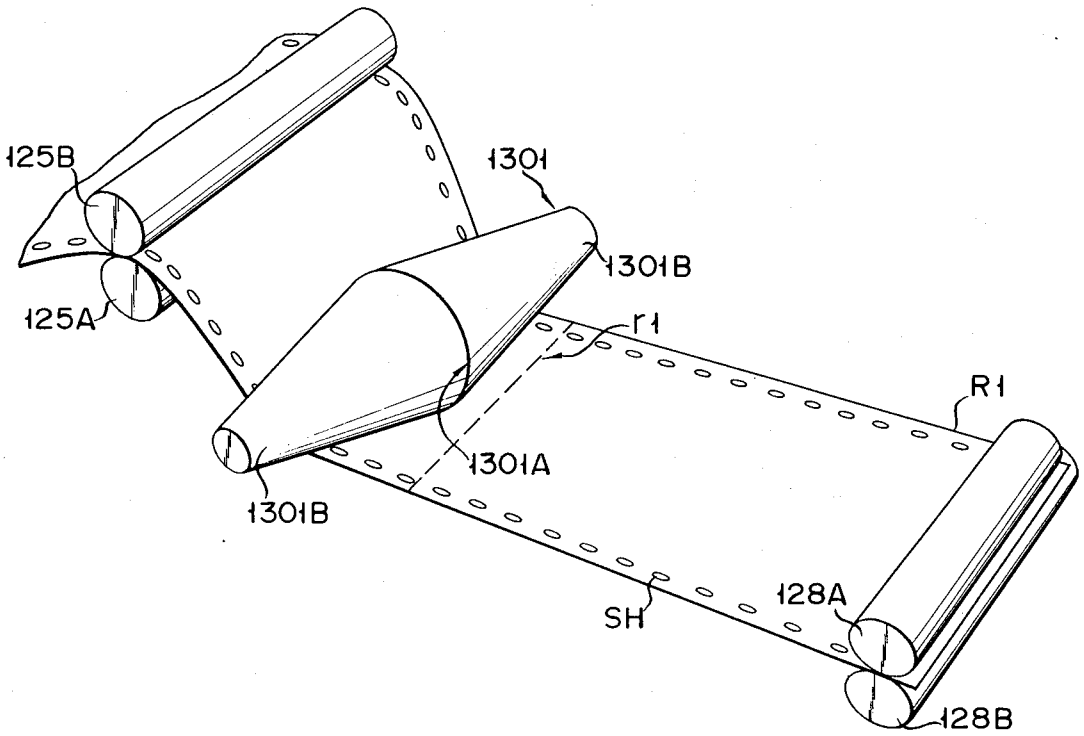
FIG. 11 is a perspective view showing the position of a guide roller in one preferred stop position.

Furthermore, the series of perforations r1 need not always be located in the position in touch with the guide roller 1301 when the sprocket wheel 120A is stopped, as shown in FIG. 7. Instead, as shown in a third modification in FIG. 11, the perforations r1 may be located in any stop position near guide roller 1301.

In the sheet separating apparatus according to the present invention, as may be understood from the above description, tension is applied to a continuous sheet having weakened lines arranged thereon at predetermined distances so that the continuous sheet is separated along the weakened lines. Thus, according to the invention, the continuous sheet can be cut without the use of a movable or fixed cutting edge, permitting a simple construction and easy maintenance of the apparatus.

What is claimed is:

1. A sheet separating apparatus for separating a sheet, which is elongated in a longitudinal direction and includes a plurality of weakened lines each crossing the longitudinal direction of said sheet, into a plurality of relatively small pieces along said weakened lines, said apparatus comprising:

first tensioning means for applying tension to said sheet in said longitudinal direction thereof; and second tensioning means for applying additional tension in said longitudinal direction which additional tension is non-uniform along successive weakened lines and which additional tension is applied while said sheet is being tensioned by said first tensioning means;

wherein said second tensioning means includes a roller located in a fixed position and having an axis extending across the width of said sheet, said roller including a plurality of disks space apart along said axis, said disks gradually decreasing in diameter from a central portion of said roller toward each end of said roller, the outer peripheries of said disks abutting against said sheet to apply non-uniform tension along the width of said sheet.

* * * * *